United States Patent [19]

Wood et al.

[11] 4,110,050

[45] Aug. 29, 1978

[54] PRINT RIBBON HANDLER

[75] Inventors: James Carlos Wood, Houston; Francis Adolph Felcman, Richmond, both of Tex.

[73] Assignee: Texas Instruments Incorporated, Dallas, Tex.

[21] Appl. No.: 784,498

[22] Filed: Apr. 4, 1977

[51] Int. Cl.[2] ..... B41J 35/04

[52] U.S. Cl. ..... 400/248; 400/213

[58] Field of Search ..... 197/151, 153 R, 153 A, 197/157, 158, 159, 170; 101/336

[56] References Cited

U.S. PATENT DOCUMENTS

| | | | |
|---|---|---|---|
| 1,031,541 | 7/1912 | Duncan | 101/336 UX |
| 1,662,220 | 3/1928 | Umstead | 197/170 |
| 2,168,364 | 8/1939 | Schaefer | 101/336 X |
| 2,202,958 | 6/1940 | McFarland | 197/153 R |
| 2,672,092 | 3/1954 | Beattie | 101/336 |
| 3,987,883 | 10/1976 | Darwin et al. | 197/170 X |
| 4,011,934 | 3/1977 | Ploby et al. | 197/170 X |

FOREIGN PATENT DOCUMENTS

| | | | |
|---|---|---|---|
| 912,319 | 4/1946 | France | 197/151 |
| 597,675 | 5/1934 | Fed. Rep. of Germany | 197/157 |
| 942,746 | 5/1956 | Fed. Rep. of Germany | 197/170 |

OTHER PUBLICATIONS

IBM Technical Disclosure Bulletin, "Helically Grooved Ribbon Guide," Bakken, vol. 13, No. 8, Jan. 1971, p. 2229.

IBM Technical Disclosure Bulletin, "Angled Ribbon Guide," Giallo et al., vol. 19, No. 10, Mar. 1977, pp. 3817–3818.

*Primary Examiner*—Ernest T. Wright, Jr.

*Attorney, Agent, or Firm*—Rene' E. Grossman; James T. Comfort; Thomas G. Devine

[57] ABSTRACT

A print ribbon handler for an impact type printer maintains the ribbon at a constant slant angle from the horizontal. A ribbon guide surface having threaded grooves is provided to guide the ribbon up and down at a constant vertical rate of change with respect to the horizontal/printhead travel back and forth across the printing span to keep the ribbon at the constant slant angle.

7 Claims, 3 Drawing Figures

10
11
12
13
14
15
16
17
18
19
21
30
31
32
33
34
35
36
37
38
40
41
41

PRINT RIBBON HANDLER

BACKGROUND OF THE INVENTION

1. Field of the Invention

This invention relates to positioning a printing ribbon between the printing mechanism and the medium upon which the printing is to be performed. More specifically, it pertains to a mechanism for maintaining the printing ribbon at a constant slant angle with the horizontal, thereby causing the printing members to strike the ribbon in an oblique line from the bottom to the top of the ribbon, in a non-repetitive manner as the ribbon circulates through the ribbon handler, thereby prolonging the life of the ribbon by spreading the load over a larger area.

2. Description of the Prior Art

Typically, a print ribbon is simply moved horizontally past a printing head thereby presenting exactly the same portion of the ribbon continually to the impact members. This configuration reduces the ribbon life substantially.

More recently, a slant ribbon technique has been employed but without a positive mechanism for providing vertical movement. For example, non-positive gripping slick guides have been used which allow the ribbon to dwell longer at one height than another causing excessive wear and reduced life. Also, rolling cylinders have been provided as ribbon guides for the slant ribbon system. These are highly susceptible to imparting an upward or downward force, driving the ribbon off the guides as a result of small angle variations of the guide journals.

By providing threaded grooves, positive gripping control is achieved and the disadvantages cited above are removed.

BRIEF SUMMARY OF THE INVENTION

In the preferred embodiment of this invention, a pair of main ribbon guides are provided for a wire matrix impact type printer to guide the printing ribbon up and down as the printhead moves across the print span. A constant vertical rate of change with respect to the horizontal carriage/printhead travel is thus maintained. This arrangement holds the ribbon at a constant slant angle with respect to the horizontal as the carriage/-printhead moves. The ribbon is tensioned in a conventional manner and wrapped across the threaded grooves providing a normal force which drives the ribbon into the threads for contact.

The principal object of this invention, therefore, is to provide a print ribbon handler that maintains the print ribbon at a constant slant angle with respect to the horizontal.

Another object of this invention is to provide a print ribbon handler that enables a larger area of the print ribbon to be utilized.

Still another object of this invention is to provide a ribbon handler than enables the print ribbon to have a longer useful life.

A further object of this invention is to utilize all possible ink in the ribbon.

These and other objects will be made evident in the detailed description that follows.

DETAILED DESCRIPTION OF THE INVENTION

Figure 1:
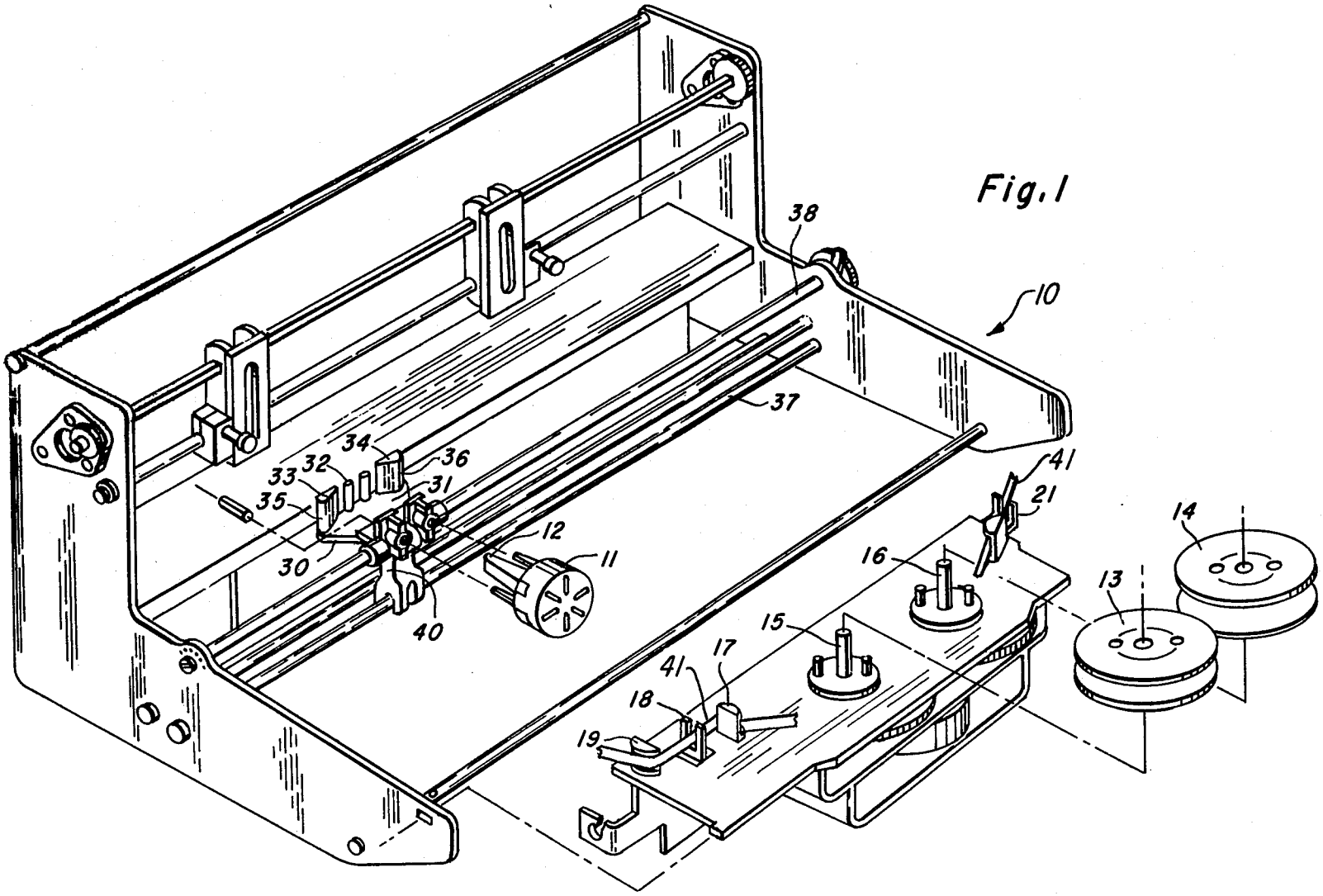
FIG. 1 is a partially exploded view of the section of an impact printer in which the invention print ribbon handler is shown in position.

FIG. 1 shows the inner framework assembly 10 of the wire matrix impact printer of the preferred embodiment of this invention. The preferred printer is the Model 810 from Texas Instruments Incorporated, Dallas, Texas. Details of the operation, construction and circuitry of the Model 810 printer are available in Texas Instruments Incorporated publications "Operating Instructions for Model 810 Printer" - No. 994,353 - 9701 and "Model 810 Printer Maintenance Manual" - No. 994,386 - 9701. Wire matrix printhead 11 having an impact end 12 is shown as it is attached to carriage assembly 40. Carriage assembly 40 is shown attached to drive screw 38 and to guide shaft 37. The carriage assembly 40 is moved from left to right and from right to left by the turning of drive screw 38 which is accomplished by an electric motor (not shown).

Print ribbon reels 13 and 14 are shown as they are mounted on spindles 15 and 16. The ribbon 41 itself is appropriately threaded around the ribbon travel path guides 17, 18 and 19 and through guide 21. The ribbon 41 ultimately passes into the print ribbon handler 30 where it is positioned for a printing operation. Print ribbon handler 30 has a base plate 31 and has a nose guide 32 attached to the front edge thereof. Guides 33 and 34 are positioned on opposite sides of nose guide 32 and contain threaded grooves 35 and 36, respectively.

Figure 2:
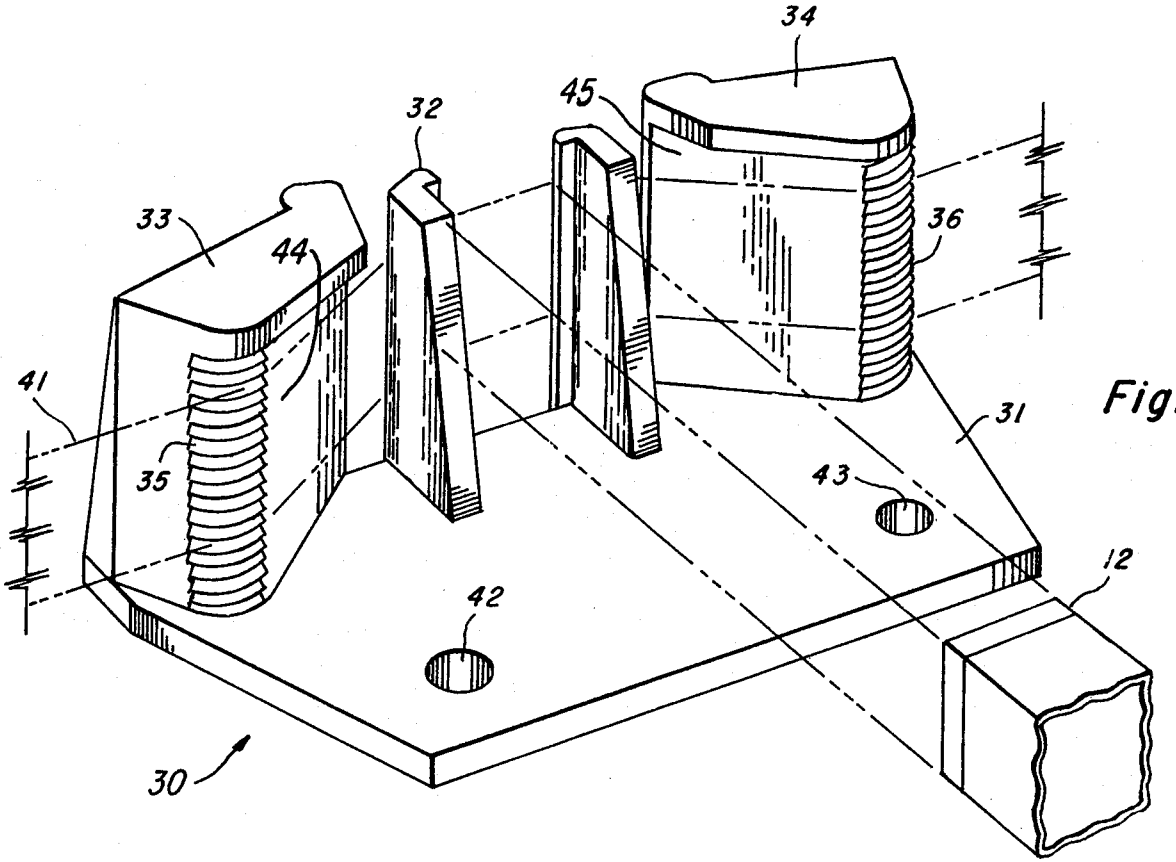
FIG. 2 is a perspective view of the print ribbon handler.

FIG. 2 illustrates the print ribbon 41, partially in phantom, contacting threaded grooves 35 and 36 on guides 33 and 34, respectively, passing between nose guide 32 and the paper (not shown) on which the printing is to be done. Print ribbon 41 also passes over bearing surfaces 44 and 45 which are integral with guides 33 and 34, respectively. The impact end 12 of printhead 11 is shown removed from nose guide 32. Apertures 42 and 43 in base plate 31 are utilized for connecting print ribbon handler 30 to carriage assembly 40.

Figure 3:
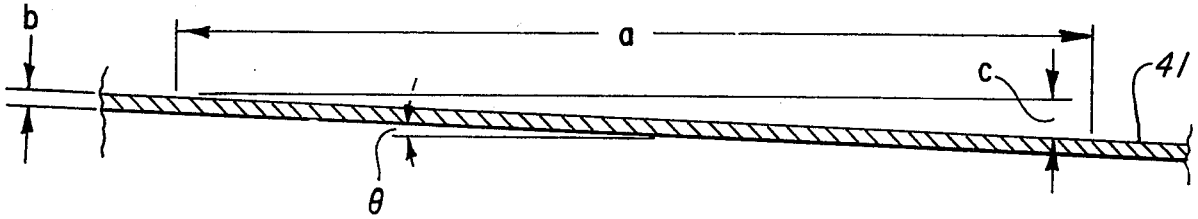
FIG. 3 illustrates a front view of the ribbon at an exaggerated slant angle to horizontal.

FIG. 3 is a simple illustration of the geometry of the ribbon 41. The printing span $a$, in this embodiment, is 13.2 inches and the ribbon width $b$ is 0.5 inches. The slant angle $\theta$ is 1°. Therefore:

$$\tan\theta = c/a$$

$$c = a \cdot \tan\theta$$

$$c = 13.2 \cdot \tan 1^\circ$$

$$c = 0.23$$

The support at each end of the printing span $a$ therefore must be displaced from each other a distance of 0.23 inches. A buffer zone of 0.085 inches at top and bottom of the ribbon 41 is excluded from any printing activity. The remaining width of ribbon 41 is therefore $0.5 - 2 \times 0.085 = 0.33$.

Then, a print height of 0.1 will traverse the 13.2 inches of printing span $a$.

A 56 threads per inch-¼ inch screw size for the threads of threaded grooves 35 and 36 was selected. The particular configuration chosen uses a right hand thread and is made of nylon containing glass bead and glass fiber. The pitch of the selected thread provides the 1° slant angle.

It is contemplated that the ribbon 41 could be reversed in pitch from that shown herein by employing left hand threads, the material of which the handler 30 is made could be a plastic or metal, there could be more or less threaded surfaces, all without departing from the scope and spirit of this invention.

What is claimed is:

1. A printer assembly of the type having a constant slant angle print ribbon with a constant vertical rate of change with respect to the horizontal movement of a carriage as the carriage moves back and forth across a printing span, comprising:

(a) a printhead, having an inpact end, mounted on the carriage; and (b) a print ribbon handler mounted on the carriage for receiving the print ribbon and for guiding the print ribbon between the printhead and a medium to be printed, including a guide surface having threads formed thereon at a pitch to provide the desired print ribbon slant angle.

2. The printer assembly of claim 1 wherein the printhead is a wire matrix printhead.

3. The printer assembly of claim 2 wherein the print ribbon handler further comprises:

(b) (i) a base plate; and (ii) a nose guide mounted at the front end of the base plate through which the impact end of the printhead passes.

4. The printer assembly of claim 3 wherein the print ribbon handler further comprises a pair of guides, upwardly disposed from the base plate, and positioned on each side of the nose guide, each of the pair of guides having a bearing surface inclined to the front end of the nose guide and each having the guiding threads formed adjacent the bearing surface at the rearward portion of the guide.

5. The printer assembly of claim 4 wherein the slant angle of the print ribbon is maintained at approximately 1° from the horizontal.

6. The printer assembly of claim 5 wherein the threads are dimensioned as 56 per inch for a ¼ inch diameter screw.

7. The printer assembly of claim 6 wherein the threads are right hand.

* * * * *